US009007188B2

(12) United States Patent
Bingley

(10) Patent No.: US 9,007,188 B2
(45) Date of Patent: Apr. 14, 2015

(54) TRANSMITTING SECONDARY REMOTE CONTROL SIGNALS

(75) Inventor: Peter Bingley, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 761 days.

(21) Appl. No.: 13/318,807

(22) PCT Filed: Apr. 28, 2010

(86) PCT No.: PCT/IB2010/051849
§ 371 (c)(1),
(2), (4) Date: Jan. 23, 2012

(87) PCT Pub. No.: WO2010/128428
PCT Pub. Date: Nov. 11, 2010

(65) Prior Publication Data

US 2012/0105216 A1 May 3, 2012

(30) Foreign Application Priority Data

May 5, 2009 (EP) ..... 09159434

(51) Int. Cl.
*G08C 23/04* (2006.01)
*G08C 17/02* (2006.01)

(52) U.S. Cl.
CPC ..... *G08C 17/02* (2013.01); *G08C 2201/41* (2013.01); *G08C 23/04* (2013.01); *G08C 2201/40* (2013.01)

(58) Field of Classification Search
CPC ..... G08C 2201/40; G08C 2201/41; G08C 23/04; G08C 17/02
USPC ..... 341/176; 340/12.52
See application file for complete search history.

(56) References Cited

U.S. PATENT DOCUMENTS

| | | | | |
|---|---|---|---|---|
| 4,388,567 | A | 6/1983 | Yamazaki et al. | |
| 7,126,291 | B2 | 10/2006 | Kruse et al. | |
| 7,221,110 | B2 | 5/2007 | Sears et al. | |
| 8,548,453 | B2 * | 10/2013 | Jeon et al. | 455/419 |
| 2004/0164875 | A1 | 8/2004 | Dischert | |
| 2007/0086754 | A1 | 4/2007 | Lys et al. | |
| 2008/0218099 | A1 | 9/2008 | Newman | |
| 2008/0252509 | A1 * | 10/2008 | Yokozawa | 341/176 |

FOREIGN PATENT DOCUMENTS

| | | | |
|---|---|---|---|
| EP | 1933287 | A2 | 6/2008 |
| JP | 2006148801 | A | 6/2006 |
| JP | 2007324737 | A | 12/2007 |

* cited by examiner

*Primary Examiner* — Daniell L Negron
*Assistant Examiner* — Benyam Haile
(74) *Attorney, Agent, or Firm* — Meenakshy Chakravorty

(57) ABSTRACT

A device for receiving a primary remote control signal and sending a secondary remote control signal where the primary remote control signal and the secondary remote control signal have the same signal-format, and where the secondary remote control signal comprises a secondary information value based upon a primary information value which is comprised by the primary remote control signal, is disclosed. The device is thus capable of eavesdropping on signals sent from a remote controller to a controllable device, and send secondary remote control signals which can be read by the controllable device.

8 Claims, 4 Drawing Sheets

TRANSMITTING SECONDARY REMOTE CONTROL SIGNALS

FIELD OF THE INVENTION

The present invention relates to the field of sending remote control signals, and more specifically to receiving a primary remote control signal and sending one or more secondary remote control signals.

BACKGROUND OF THE INVENTION

Remote controller devices can be used to adjust a setting of a device, such as the loudness of an amplifier or the brightness of a lamp. An example of this is given in the reference U.S. Pat. No. 7,221,110 B2. The reference relates to a lighting control system including light controllers with microprocessor-based intelligence. The microprocessor-based intelligence executes a lighting script during operation. A problem in such systems is that they are not straightforward to implement into existing systems of remote controllers and controllable devices.

Hence, it would be desirable to have an improved controller device which can easily function with existing remote control systems. Furthermore, it would be desirable to add functionality to existing systems of remote controllers and controllable devices.

SUMMARY OF THE INVENTION

Accordingly, the invention preferably seeks to mitigate, alleviate or eliminate the above mentioned disadvantage of a lighting control system which cannot be easily implemented into existing systems. In particular, it may be seen as an object of the present invention to provide a device that solves the above mentioned problems of the prior art by providing an apparatus which can function with existing systems of remote control systems.

This object and several other objects are obtained in a first aspect of the invention by providing a device for sending a secondary remote control signal, comprising:

- an input for receiving a primary remote control signal comprising a primary information value,
- a processing unit arranged to determine a secondary information value based upon the primary information value, where the secondary value is different from the primary value,
- an output arranged for transmitting the secondary remote control signal comprising the secondary information value to a controllable receiver device, where the primary remote control signal and the secondary remote control signal have the same signal-format.

The invention is particularly, but not exclusively, advantageous for obtaining relatively straightforward implementation into existing systems, as the device receives a primary remote control signal and transmits a secondary remote control signal of the same signal-format, meaning that the device can be integrated into an existing system comprising remote controllers and controllable devices. In other words, since the primary remote control signal and the secondary remote control signal have the same signal-format, the device is able to eavesdrop on a wireless signal and, possibly, to change part of the wireless signal so that the controllable device can be controlled with a different control parameter than originally sent from the remote controller.

Furthermore, the invention can add functionality to an existing system, comprising associated remote controller and controllable device, due to the transmission of the secondary remote control signal of the same signal-format. This can, as an example, be used to change a setting of the controllable device in response to the receipt of a primary remote control signal and can hence constitute a functionality beyond the functionality of the existing system. Thus, the basic idea of the invention is to eavesdrop on a primary remote control signal, and transmit a secondary remote control signal, which may or may not be similar to the primary remote control signal, but which is of the same signal-format. Thus, it is understood that the primary and secondary remote control signals may have the same signal format, but the signals need not be similar or identical since the secondary value may be different from the primary value when the secondary information value is based upon the primary information value. That is, the processing unit may determine the secondary value as a function of the primary value. It may occur, at some time that the processing unit determines a secondary value which is identical to the primary value so that the secondary remote control signal is similar or identical to the primary remote control signal.

The device may further comprise a memory for storing the primary information value and the processing unit may be arranged to determine a secondary information value based upon the stored primary information value. Additionally, this memory or a separate memory may be configured for storing the secondary information value, e.g. for further processing or later use of the secondary information value.

Further, according to another embodiment, a memory is configured for storing a receiver-identity value of the primary remote control signal, where the receiver-identity value enables identification of at least one controllable receiver device. Accordingly, the processing unit may be configured for extracting the receiver identity value from the primary control signal and store the receiver identity value in the memory.

In addition, the memory for storing the receiver-identity value or a separate memory might be configured for storing a sender-identity value. A possible advantage of this feature is that the device for sending a secondary remote control signal can then impersonate the sender of the primary remote control signal by cloning, or copying, the sender-identity value. This can for example be advantageous in case a controllable receiver device is configured to only accept remote control signals from senders with a specific sender-identity value.

Still further, according to another embodiment, the processing unit and the output are arranged to combine and transmit the stored receiver-identity value with the secondary information value. It may be advantageous to combine and transmit the receiver-identity value with the secondary information value, so that the device can send the secondary information value to the same controllable receiver as the primary information value was intended for. Combining and transmitting the stored receiver-identity value with the secondary information value merely clones the receiver-identity value and combines it with a new information value.

In another embodiment, the processing unit is arranged to determine a plurality of secondary information values, based upon the primary information value. Accordingly, a plurality of secondary information values are determined, which can be sent to a plurality of controllable devices, to a plurality of specified controllable devices using one or more receiver-identities. Furthermore, the plurality of secondary information values can also be send over a period of time to one or more controllable devices, possibly using receiver-identities to specify which devices should receive which secondary information values.

Further, in yet another embodiment, the output is arranged to transmit a plurality of secondary remote control signals, comprising the plurality of secondary information values, distributed over a period of time. This might assist in achieving a dynamic atmosphere, as the setting of a controllable device can consequently be changed over time, such as changing the color of light emitted from a lamp over time.

In another embodiment, a memory is configured for storing first and second receiver-identity values of the primary remote control signal, where the first and second receiver-identity value enables identification of first and second controllable receiver devices. By storing first and second receiver-identity values of the primary remote control signal, the device of this particular embodiment, might address specifically first and second controllable receiver devices with different or identical secondary information values, which may enable dynamic control of multiple controllable devices.

Thus, in a related embodiment, the processing unit and the output are further arranged to combine and transmit the first and second receiver-identity values with the secondary information value. This might enable the device of this embodiment to send the secondary information value to specific controllable devices associated with the first and second receiver-identity values.

In another related embodiment, the processing unit and the output are further arranged to combine the first and second receiver-identity values with first and second secondary information values, determined from the primary information value. This might enable the device of this embodiment to send different first and second secondary information values, respectively, to specific controllable devices associated with the first and second receiver-identity values.

In another embodiment, the processing unit is arranged to determine the one or more secondary information values using an algorithm stored in the device. The algorithm might comprise a mathematical function, such as a sinusoidal function, or more complex functions including a plurality of terms or conditions varying over time. Using an algorithm might be one way to make the device of the embodiment determine a plurality of secondary information values based upon the primary information value.

Further, in yet another embodiment of the invention, the algorithm comprises a random generator for randomly determining the one or more secondary information values. This can be helpful in creating surprising and unpredictable secondary information values, as the algorithm might take, as input, random values which can vary from time to time.

In another embodiment, the processing unit is arranged to determine the secondary information value based on first and second primary information values received by the input. Advantageously, this might enable the processor to determine a secondary information value by taking into account, not only the specific values of the first and second primary information values, but also their difference, sum, average, etc., and further to take into account the period of time between receipt of respectively the first and second primary remote controls signals which contains the first and second information values. The first and second primary information values may be received and subsequently stored in a memory comprised by the device.

In a related embodiment, the device is arranged to determine a plurality of secondary information values based on first and second primary information values received by the input. This might enable the device to take into account, when determining the secondary information values, information received within the primary remote control signals, beyond the primary information values themselves, such as the time period between reception of two primary remote control signals or the degree of dissimilarity between two primary information values. An algorithm used in determining the secondary information values may thus be configured to determine the dynamic range of variation amongst a plurality of determined secondary information values based upon the degree of dissimilarity between the primary information values. The secondary values might thus be based not only on the specific values of the primary information values, but also the difference, sum, average, standard deviation, etc., of the primary information values, and further the times of receipt of the primary information values might be taken into account. E.g., in the case of a light controller, where the color of the light can be controlled, primary information values representing 'red' and 'blue' gives a broad dynamic range giving light variations from red to blue. Primary information values representing 'blue' and 'light blue' gives a narrower dynamic range. The frequency of the changes of the secondary values might be affected by the delay between the two consecutive primary remote control signals associated with primary information values representing 'blue' and 'light blue'.

Similarly, to a memory configured for storing the secondary information value, this memory or a separate memory comprised by the device may be configured for storing the plurality of secondary information values for further processing or later use.

In another embodiment, the processing unit is arranged to determine the secondary information value based upon the primary information value and an auxiliary sensor signal. A possible advantage of this, is that the secondary information values, and possibly hence the settings of a controllable device, can be affected in an appropriate manner by the auxiliary sensor signal. The auxiliary sensor signal might be affected by temperature, light, sound or other factors related to the ambient conditions. For example, an auxiliary sensor signal in the form of a level of sound can have an effect on the secondary information value in the form of a level of light.

In a second aspect of the invention, a system is provided, the system comprising:

one or more devices according to the first aspect of the invention, one or more controllable devices capable of receiving the secondary remote control signal from the one or more devices and adjusting a setting accordingly based upon the received secondary remote control signal.

In a third aspect of the invention, a method for sending a secondary remote control signal is provided, the method comprising:

receiving, via an input, a primary remote control signal comprising a primary information value, determining in a processing unit a secondary information value based upon the primary information value, where the secondary value is different from the primary value, transmitting, via an output, the secondary remote control signal comprising the secondary information value to a controllable receiver device, where the primary remote control signal and the secondary remote control signal have the same signal-format. This method is particularly, but not exclusively, advantageous for obtaining relatively straightforward implementation into existing systems, as the method prescribes receiving a primary remote control signal and transmitting a secondary remote control signal of the same signal-format, meaning that the device can be integrated into an existing system comprising remote controllers and controllable devices. Furthermore, the method can add functionality to an existing system, comprising associated remote controller and controllable device, due to the transmission of the secondary remote control signal of the same signal-format. This can, as an example, be used to change a setting of the controllable device in response to the receipt of a primary remote control signal and can hence constitute a functionality beyond the functionality of the existing system.

The first, second and third aspect of the present invention may each be combined with any of the other aspects. These and other aspects of the invention will be apparent from and elucidated with reference to the embodiments described hereinafter.

BRIEF DESCRIPTION OF THE FIGURES

The present invention will now be explained, by way of example only, with reference to the accompanying Figures, where.

DETAILED DESCRIPTION OF AN EMBODIMENT

Figure 1:
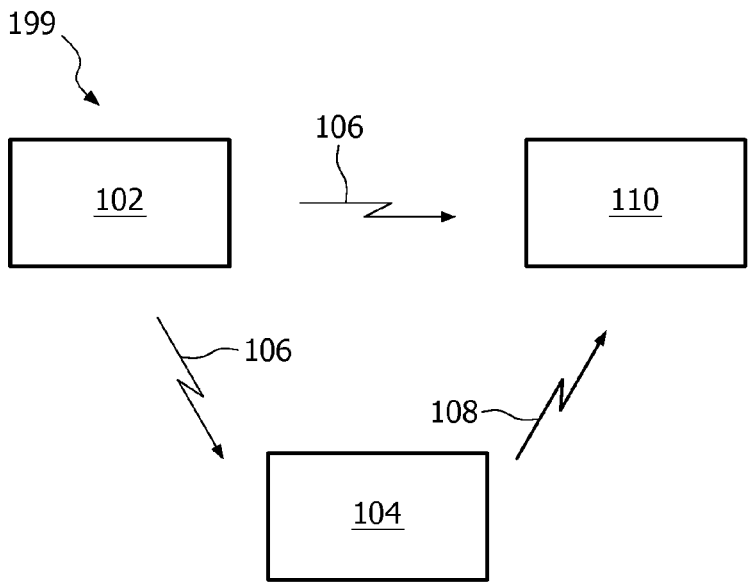
FIG. 1 shows a schematic illustration of an embodiment of the invention.

FIG. 1 shows an embodiment of the invention in which a device 104 receives a primary remote control signal 106 comprising a primary information value from a remote controller 102. The primary remote control signal 106 is transmitted wirelessly in the shown embodiment and is of a format which could also be received by a controllable receiver device 110. The primary remote control signal and the secondary remote control signal can be realized using all kinds of remote control technologies, which may be wireless or transmitted using cables or other solid connection lines, including radio frequency (RF) technology, infrared (IR) technology, and internet protocols (IP) technology. The device 104 extracts the primary information value from the primary remote control signal 106 and utilizes an internal processor to determine a secondary information value based upon the primary information value. This might be done using a memory for storing values, such as the primary value or values used in intermediate calculations leading to determination of the secondary information value. Via an output associated with the device 104, a secondary remote control signal 108 comprising the secondary information value is transmitted in the same format as the primary remote control signal 106. The primary information value may be embedded in the primary control signal 106, for example as a digital value. Similarly, the secondary information value may be embedded as a digital number in the secondary signal. The controllable device 110 is able to receive and interpret the secondary remote control signal 108 and consequently able to adjust a setting in accordance with the secondary information value. The formats of the primary and secondary remote control signals are the same, meaning that the controllable device can interpret a secondary remote control signal just as well as it can interpret a primary remote control signal. An example of a system of remote controller 102 and controllable device 110 is constituted by a system comprising respectively a remote controller and a lamp, wherein the remote controller can be used to change the color of the lamp as well as the brightness of the lamp. In this particular system, the device 104 might receive a primary remote control signal, sent from the remote controller and receivable by the lamp as well as device 104, which comprises a primary information value representing the color 'blue' and determine a secondary information value representing the color 'red' which is sent within a secondary remote control signal of the same signal format as the primary remote control signal, meaning that the lamp can interpret the secondary remote control signal. Upon reception of the secondary remote control signal, the lamp can change the color of the light to the color 'red'. Although this system represents one example of a particular system, numerous other examples are possible, such as remote controllers and televisions, radios, amplifiers, ventilation systems, temperature control systems, light fixtures, controllable picture frames etc.

Figure 2:
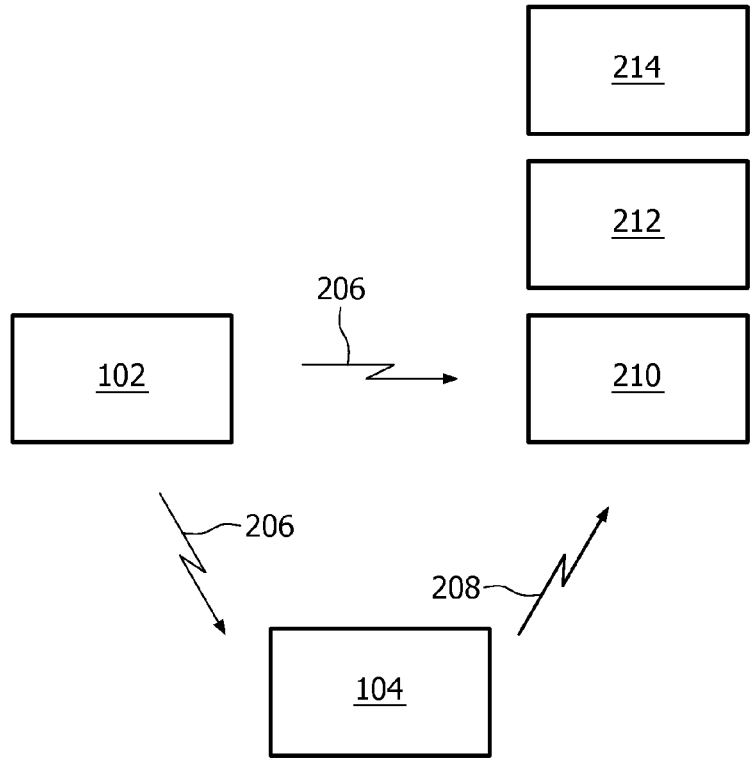
FIG. 2 shows a schematic illustration of another embodiment of the invention.

FIG. 2 shows a device 104 which receives a primary remote control signal 206 comprising a receiver-identity from a remote controller 102. The receiver-identity may be an address of a controllable device enabling the remote controller 102 to identify a particular controllable device, i.e. to send a message to a particular controllable device. The primary remote control signal 206 comprising a receiver-identity is transmitted wirelessly in the shown embodiment and is of a format which could also be received by controllable devices 210, 212, 214. The device 104 extracts a primary information value from the primary remote control signal 206 and utilizes an internal processor to determine a secondary information value based upon the primary information value. Via an output associated with the device 104, a secondary remote control signal 208 comprising the secondary information value and a receiver-identity is transmitted in a format similar to the format of the primary remote control signal 206 and a receiver-identity. In the shown example, the receiver-identity matches an identity of the controllable device 210. The controllable device 210 is able to receive and interpret the secondary remote control signal with a receiver-identity and, as the receiver-identity of the secondary remote control signal matches the identity of controllable device 210, the controllable device 210 is consequently able to adjust a setting in accordance with the secondary information value of the secondary remote control signal 208. Controllable devices 212, 214 in the shown example have identities which do not match the receiver-identity of the secondary remote control signal 208 and consequently does not adjust any setting in accordance with the secondary information value of the secondary remote control signal 208. In the shown schematic illustration, the receiver-identity matches a single device; however, a receiver identity can also be used to identify a plurality of devices, such as a particular group of devices, or a particular type of devices. Further, a receiver-identity can be stored within device 104 in order to subsequently combine a secondary information value with the stored receiver-identity; the combination can then be carried out even if a receiver-identity has not been received together with the primary remote control signal 206 which contained the primary information value upon which the secondary information value was based. The combination may be performed in numerous ways, including attaching the receiver-identity within the secondary remote control signal 208 prior- or subsequent to the secondary information value, or by fully or partially embedding the receiver-identity into the secondary information value within the secondary remote control signal 208.

Figure 3:
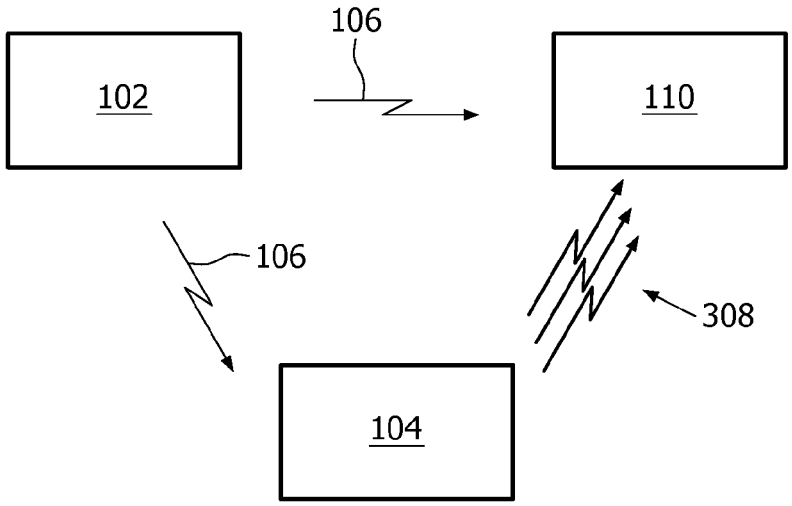
FIG. 3 shows a schematic illustration of yet another embodiment of the invention.

FIG. 3 shows a device 104 which receives a primary remote control signal 106 from a remote controller 102. The primary remote control signal 106 is transmitted wirelessly in the shown embodiment and is of a format which could also be received by controllable device 110. The device 104 extracts a primary information value, from the primary remote control signal 106, and utilizes an internal processor to determine a plurality of secondary information values based upon the primary information value. Via an output associated with the device 104, a plurality of secondary remote control signals 308 comprising the plurality of secondary information values are transmitted, distributed over a period of time, in a format similar to the format of the primary remote control signal 106. During the period of time, over which the plurality of secondary remote control signals are transmitted, the controllable device 110 is able to receive and interpret each of the secondary information values comprised within the plurality of remote control signals 308. The controllable device 110 hence is able to adjust, again and again, a setting in accordance with the secondary information value received with a secondary remote control signal of the plurality of secondary remote control signals 308. This allows a user to send a setting via the remote controller 102 and subsequently rely on the device 104 to send, over a period of time, a plurality of secondary remote control signals 308, which have the effect of changing, again and again, a setting of controllable device 110. This could create a dynamic atmosphere if the setting of the controllable device 110 influences the atmosphere, which could be the case if the controllable device 110 were, for example, a lamp, an amplifier, or a ventilator.

Furthermore, the plurality of secondary information values illustrated in FIG. 3 can be sent to a plurality of devices, simultaneously, substantially simultaneously or distributed in time. This can be done in order to control a plurality of controllable devices, or in order to create a spatial effect by combining the plurality of secondary information values with a plurality of receiver-identities. The combination of sending pluralities of secondary information values distributed in space or time is within the scope of the invention, such as in order to create wave-like effects or other effects which benefit from variations in both time and space.

Figure 4:
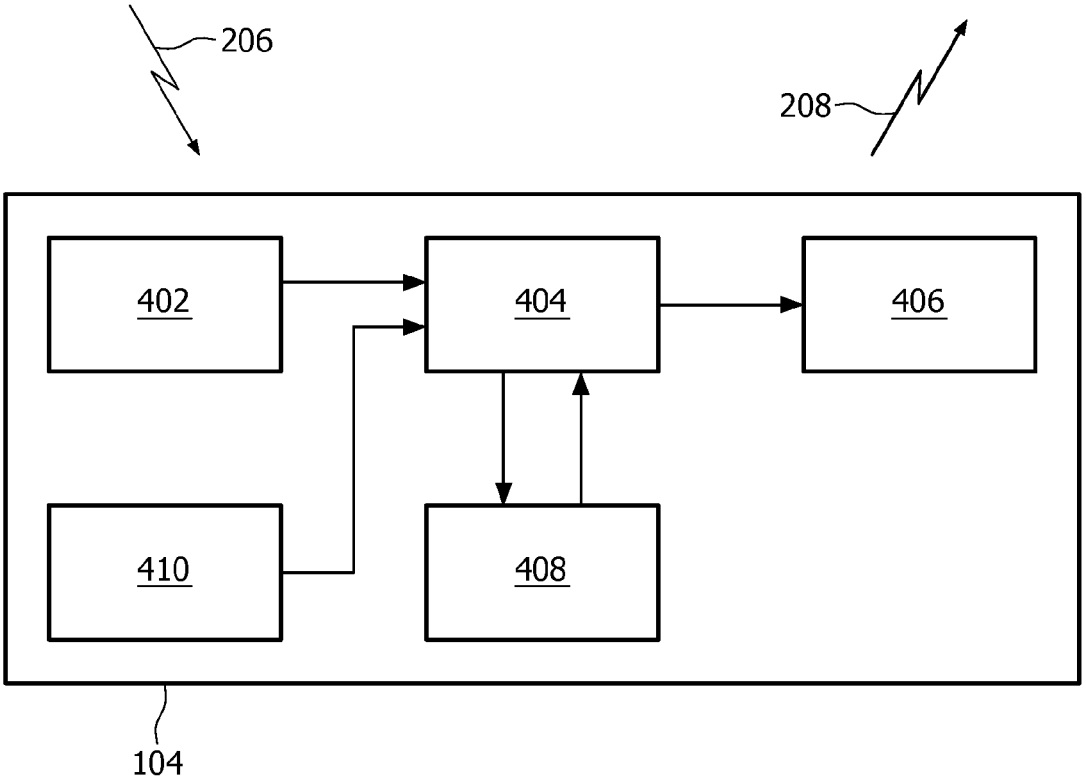
FIG. 4 shows a schematic illustration of the internals of an embodiment of the invention.

FIG. 4 shows the internals of device 104. The device 104 comprises an input 402 for receiving a primary remote control signal 106 comprising a primary information value, a processing unit 404 which is arranged to determine a secondary remote control value based upon the primary information value, an output 406 for transmitting the secondary remote control signal 108 comprising the secondary information value. The primary remote control signal 106 and the secondary remote control signal 108 have the same signal-format. The shown embodiment furthermore comprises a memory unit 408 which may be used for storing a primary information value and/or a receiver-identity value. The processor 404 can save information in the memory unit 408, for example a received receiver-identity, and can also read data from the memory unit 408. In addition, the shown embodiment also comprises an auxiliary sensor 410, for generating an auxiliary sensor signal to the processor 404. This auxiliary sensor signal can be used by the processor as an input value when determining a secondary remote control value. For example, in an embodiment of the invention, the controllable device is a lighting unit, the auxiliary sensor 410 is a sensor capable of determining the level of brightness, and the processor 404 of the device 104 takes the level of brightness into account when determining the secondary remote control value which is a representation of a level of brightness of the lighting unit. In another example the controllable device is an audio system in which the auxiliary sensor is a microphone monitoring a loudness level and adjusts the loudness of the audio system to be at a certain level compared to the background loudness. In this example, the device might be able to filter out the output of the audio system itself in order to avoid disadvantageous feedback effects. In yet another example, the device 104 might be supportive of cross-modal effects, e.g., the controllable device is a lamp, with adjustable light-intensity, while the auxiliary sensor 410 is a microphone monitoring a loudness level of sound which generates an auxiliary sensor signal which affects the determination of secondary information values which in turn adjusts the intensity of the light of the lamp. This latter example shows a cross-modal effect, in that a level of sound can have an effect on a level of light.

Alternatively, the auxiliary sensor is an input from an alarm, such as a fire alarm or a baby monitor, which can determine secondary information values representing intermittent red light of a lamp, or a decline in loudness of an audio system.

Figure 5:
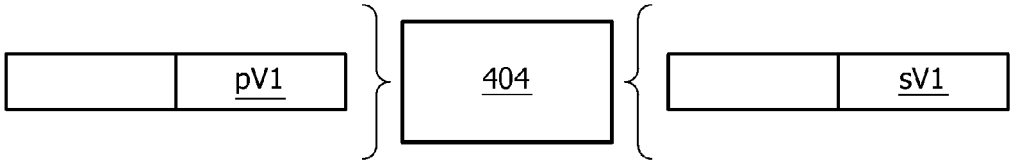
FIGS. 5-9 show schematic illustrations of primary and secondary information values, receiver-identities and sender-identities and primary and secondary remote control signals.
Figure 6:
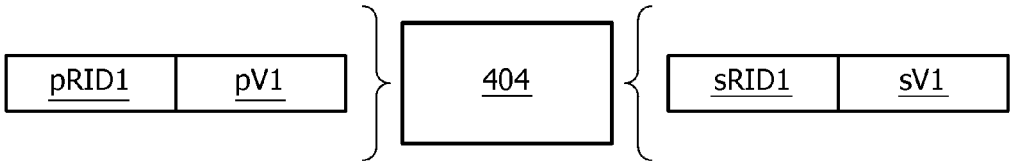

FIG. 5 shows a first primary information value pV1 which is received by the processor 404 and a first secondary information value sV1 is determined FIG. 6 shows a first primary information value pV1 which is received by the processor 404 and a first secondary information value sV1 is determined Furthermore, a receiver-identity pRID1 is comprised within the primary control signal and is associated with the first primary information value pV1. The receiver-identity pRID1 can be cloned or copied into an identical receiver-identity sRID1 and combines the first secondary information value sV1 with receiver-identity sRID1. It might also be possible to have examples where the received receiver-identity pRID1 is different from a stored receiver-identity sRID1, such that another controllable device than the one associated with the receiver-identity pRID1 can be controlled. Further, it might be possible that no receiver-identity is received, as is the case schematically depicted in FIG. 5, but where transmitted secondary information values are anyway associated with a stored receiver-identity.

FIG. 6 shows that the primary remote control signal comprising pRID1 and pV1 and the secondary remote control signal comprising sRID1 and sV1 have the same signal-format. That is, the protocol structure of primary remote control signal may be identical to the secondary remote control since the information values pV1, sV1 and the receiver-identity values pRID1 and pV1 are organized in the same way. Furthermore, the equivalence between the primary remote control signal and the secondary remote control signal may be given by the identical durations and data-formats of the received and transmitted signals, information values and receiver-identity values.

Figure 7:
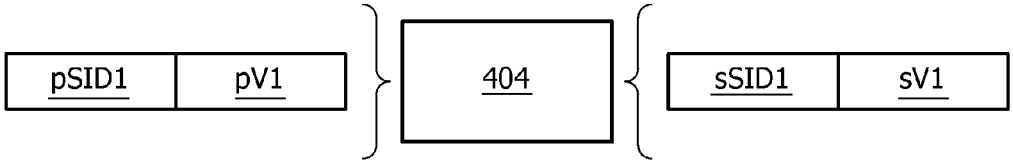

FIG. 7 shows a first primary information value pV1 which is received by the processor 404 and a first secondary information value sV1 is determined Furthermore, a sender-identity pSID1 is comprised within the primary control signal and is associated with the first primary information value pV1. The sender-identity pSID1 can be cloned or copied into an identical sender-identity sSID1 and combines the first secondary information value sV1 with sender-identity sSID1. It might also be possible to have examples where the received sender-identity pSID1 is different from a stored sender-identity sSID1, such that a remote control with sender-identity sSID1 can be impersonated. This can be helpful, for example, if a controllable device is programmed to accept only remote control signals associated with a certain sender-identity. Further, it might be possible that no sender-identity is received, but where transmitted secondary information values are anyway associated with a stored sender-identity. It might be a possibility to combine a secondary information value with both receiver-identity and sender-identity, in which case the secondary remote control signal consists of secondary information value, receiver-identity and sender-identity. The receiver-identity might be cloned from the received receiver-identity or it might be a stored receiver-identity. Similarly, the sender-identity might be cloned from the received sender-identity or it might be a stored sender-identity.

Figure 8:
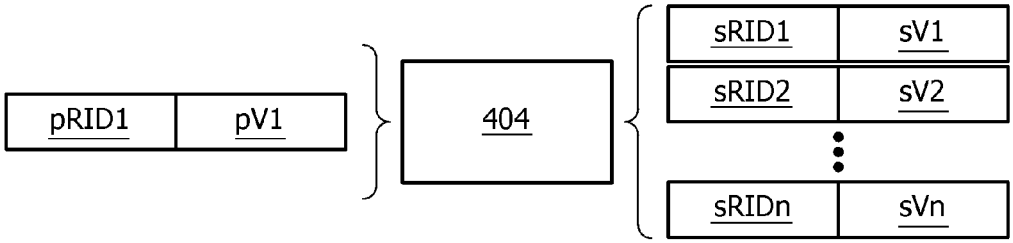

FIG. 8 shows a first primary information value pV1 which is received by the processor 404 and a plurality of secondary information value from the first secondary information value sV1 up to the n'th secondary information value sVn, which are determined by the processor 404. The secondary information values can be transmitted over time and space, such as over a period of time and to different controllable devices. Furthermore, a receiver-identity pRID1 is comprised within the primary control signal and is associated with the first primary information value pV1. The receiver-identity pRID1 can be cloned into each of the receiver-identities, sRID1, sRID2 up to sRIDn, combined with the secondary information values sV1, sV2 up to sVn. It might also be possible to have examples where the received receiver-identity pRID1 is different from stored receiver-identities, such that another controllable device than the one associated with the receiver-identity pRID1 can be controlled, or a plurality of controllable devices can be controlled. Further, it might be possible that no receiver-identity is received, as is the case schematically depicted in FIG. 5, but where transmitted secondary information values are anyway associated with a stored receiver-identity.

Figure 9:
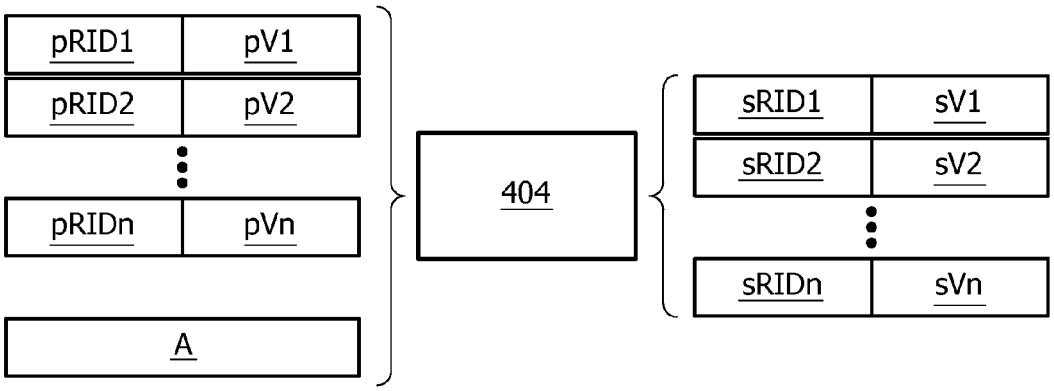

FIG. 9 shows a plurality of first primary information values pV1, pV2 up to pVn, which are received by the processor 404 and where receiver-identities pRID1, pRID2 up to pRIDn are cloned or copied into respective receiver-identities, sRID1, sRID2 up to sRIDn to be combined with secondary information values. Furthermore, processor 404 receives an input A from an auxiliary sensor. Also shown are a plurality of secondary information values represented by sV1 up to the n'th secondary information value sVn, which are determined by processor 404. The input primary information values, as well as the input A from the auxiliary sensor might come from different remote controllers and be distributed in time. For example, there might be input two primary information signals upon which a plurality of secondary information values are determined, but during the period over which the secondary information values are transmitted, one or more input values from the auxiliary sensor might affect the secondary information values, which have not yet been sent. This might mean that the determined secondary information values are modified, or that they are discarded and possibly replaced by novel secondary information values. Alternatively, the secondary information values are determined sequentially, for example a set of secondary information values are determined, whereupon a new value is received from the auxiliary sensor, then another set of secondary information values are determined, then a new value is received from the auxiliary sensor, and so forth.

Figure 10:
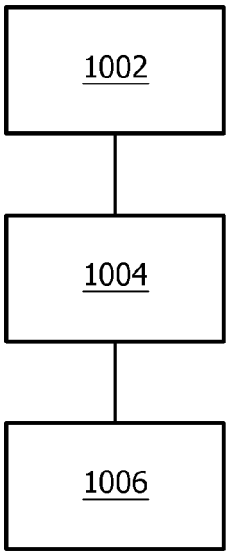
FIG. 10 shows a flow-chart of a method of an embodiment.

FIG. 10 shows a flow-chart in which a primary remote control signal comprising a primary information value is received, via an input, in step 1002. The primary remote control value might be sent from a remote controller, and might comprise a primary information value representing an instruction for changing a setting of a controllable device to a certain value, for example the color or brightness of a lamp, or the loudness of an audio system. In step 1004 one or more secondary information values are determined, the secondary information values being based, at least partially, upon the primary information value. In particular, the influence from the primary information value might vary from unambiguously determining the secondary information value to only instigating the process of determining the secondary information value while not influencing the determination of the secondary information value itself. In one example, the receipt of a primary remote control signal comprising a primary information value triggers a certain response in terms of determination of a plurality of secondary information values which are unambiguously determined by the primary information value. In this example, the determination may depend on the point in time the primary remote control signal is received and/or the specific value of the primary information value. In another example, the receipt of the primary remote control signal triggers a certain response in terms of determination of a plurality of secondary information values, but the secondary information values might not depend on the specific value of the primary information value. The determination of the secondary information values might be done using an algorithm, and various inputs such as, a random generator, and an auxiliary sensor. In step 1006 the secondary information values are sent within secondary remote control signals via an output. The secondary remote control signals might be distributed over a period of time and might be associated with receiver-identities.

To sum up, an invention is disclosed which provides a device for receiving a primary remote control signal and sending a secondary remote control signal where the primary remote control signal and the secondary remote control signal have the same signal-format, and where the secondary remote control signal comprises a secondary information value based upon a primary information value which is comprised by the primary remote control signal. The device is thus capable of eavesdropping on signals sent from a remote controller to a controllable device, and send secondary remote control signals which can be read by the controllable device.

Although the present invention has been described in connection with the specified embodiments, it is not intended to be limited to the specific form set forth herein. Rather, the scope of the present invention is limited only by the accompanying claims. In the claims, the term "comprising" does not exclude the presence of other elements or steps. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Furthermore, reference signs in the claims shall not be construed as limiting the scope.

The invention claimed is:

1. A device for sending a secondary remote control signal comprising:

an input for receiving a primary remote control signal comprising a primary information value, a processing unit arranged to determine a secondary information value based upon the primary information value, where the secondary value is different from the primary value, an output arranged for transmitting the secondary remote control signal comprising the secondary information value to a controllable receiver device, wherein the primary remote control signal and the secondary remote control signal have the same signal-format, wherein the processing unit is arranged to determine a plurality of secondary information values, based upon the primary information value.

2. The device according to claim 1, wherein the output is arranged to transmit a plurality of secondary remote control signals, comprising the plurality of secondary information values, distributed over a period of time.

3. The device according to claim 1, wherein a memory is configured for storing first and second receiver-identity values of the primary remote control signal, where the first and second receiver-identity value enables identification of first and second controllable receiver devices.

4. The device according to claim 1, wherein the processing unit is arranged to determine the one or more secondary information values using an algorithm stored in the device.

5. The system comprising: one or more devices according to claim 1, one or more controllable devices capable of receiving the secondary remote control signal from the one or more devices and adjusting a setting accordingly based upon the received secondary remote control signal.

6. A device for sending a secondary remote control signal comprising:

an input for receiving a primary remote control signal comprising a primary information value;

a processing unit arranged to determine a secondary information value based upon the primary information value, where the secondary value is different from the primary value;

an output arranged for transmitting the secondary remote control signal comprising the secondary information value to a controllable receiver device, wherein the primary remote control signal and the secondary remote control signal have the same signal-format;

wherein a memory is configured for storing first and second receiver-identity values of the primary remote control signal, where the first and second receiver-identity value enables identification of first and second controllable receiver devices;

wherein the processing unit is further arranged to combine the first and second receiver-identity values with the secondary information value, and the output is further arranged for transmitting secondary remote control signals comprising respective combined values to the first and second controllable receiver devices.

7. A device for sending a secondary remote control signal comprising:

an input for receiving a primary remote control signal comprising a primary information value;

a processing unit arranged to determine a secondary information value based upon the primary information value, where the secondary value is different from the primary value;

an output arranged for transmitting the secondary remote control signal comprising the secondary information value to a controllable receiver device, wherein the primary remote control signal and the secondary remote control signal have the same signal-format;

wherein a memory is configured for storing first and second receiver-identity values of the primary remote control signal, where the first and second receiver-identity value enables identification of first and second controllable receiver devices;

wherein the processing unit is further arranged to combine the first and second receiver-identity values with first and second secondary information values, determined from the primary information value, and the output is further arranged for transmitting secondary remote control signals comprising respective combined values to the first and second controllable receiver devices.

8. A device for sending a secondary remote control signal comprising:

an input for receiving a primary remote control signal comprising a primary information value;

a processing unit arranged to determine a secondary information value based upon the primary information value, where the secondary value is different from the primary value;

an output arranged for transmitting the secondary remote control signal comprising the secondary information value to a controllable receiver device, wherein the primary remote control signal and the secondary remote control signal have the same signal-format;

wherein the processing unit is arranged to determine the one or more secondary information values using an algorithm stored in the device;

wherein the algorithm comprises a random generator for randomly determining the one or more secondary information values.

* * * * *